US009715795B2

(12) United States Patent
Butterbaugh et al.

(10) Patent No.: US 9,715,795 B2
(45) Date of Patent: Jul. 25, 2017

(54) INDICATOR MODULE FOR MODULAR COMPUTING UNITS

(71) Applicant: International Business Machines Corporation, Armonk, NY (US)

(72) Inventors: Matthew A. Butterbaugh, Rochester, MN (US); Eric A. Eckberg, Rochester, MN (US); Camillo Sassano, Durham, NC (US); Kevin L. Schultz, Raleigh, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 40 days.

(21) Appl. No.: 14/528,538

(22) Filed: Oct. 30, 2014

(65) Prior Publication Data

US 2016/0125706 A1 May 5, 2016

(51) Int. Cl.
*G08B 5/36* (2006.01)

(52) U.S. Cl.
CPC ..... *G08B 5/36* (2013.01)

(58) Field of Classification Search
CPC ..... G11B 33/126; G11B 33/128; G06F 1/186; G06F 1/187; G06F 1/183
See application file for complete search history.

(56) References Cited

U.S. PATENT DOCUMENTS 5,216,579 A * 6/1993 Basara ..... G06F 1/184 174/481
6,084,768 A * 7/2000 Bolognia ..... G06F 1/184 248/636
6,231,224 B1 * 5/2001 Gamble ..... G06F 1/184 361/679.33
6,459,571 B1 * 10/2002 Carteau ..... G06F 1/184 312/35
6,957,291 B2 * 10/2005 Moon ..... G06F 3/0607 361/679.37
7,200,008 B1 * 4/2007 Bhugra ..... G11B 25/043 361/679.21
7,688,578 B2 * 3/2010 Mann ..... H05K 7/20745 361/679.46
7,916,423 B2 * 3/2011 Starr ..... G11B 33/125 360/92.1
8,743,549 B2 6/2014 Frink et al.
9,019,708 B2 * 4/2015 Shinsato ..... G06F 1/181 361/724
9,141,156 B2 * 9/2015 Ross ..... G06F 1/20
(Continued)

FOREIGN PATENT DOCUMENTS

WO 2014099881 A1 6/2014

*Primary Examiner* — Hai Phan
*Assistant Examiner* — Son M Tang
(74) *Attorney, Agent, or Firm* — Patterson + Sheridan, LLP

(57) ABSTRACT

Embodiments include a system that includes a first modular computing unit comprising a first signal communication interface, and an indicator module coupled to the first modular computing unit. The indicator module comprises, on a first side wall of the indicator module, a second signal communication interface adapted to register with the first signal communication interface of the first modular computing unit, thereby communicatively coupling the indicator module with the first modular computing unit in order to propagate signals from the first modular computing unit for display on the indicator module.

19 Claims, 6 Drawing Sheets

(56) References Cited

U.S. PATENT DOCUMENTS

| | | | | |
|---|---|---|---|---|
| 2003/0227703 | A1* | 12/2003 | Hinshaw | G11B 33/121 360/55 |
| 2004/0128442 | A1* | 7/2004 | Hinshaw | G06F 11/2069 711/114 |
| 2005/0022051 | A1* | 1/2005 | Zane | G06F 11/2058 714/6.12 |
| 2006/0161936 | A1* | 7/2006 | Permut | G11B 33/022 720/657 |
| 2006/0187634 | A1* | 8/2006 | Tanaka | G06F 1/181 361/679.33 |
| 2007/0258166 | A1* | 11/2007 | Kumpon | G11B 15/6835 360/92.1 |
| 2011/0222234 | A1* | 9/2011 | Davis | G11B 33/128 361/679.33 |
| 2011/0228473 | A1* | 9/2011 | Anderson | G02B 6/4452 361/679.58 |
| 2012/0293942 | A1* | 11/2012 | Moser | G06F 1/1616 361/679.26 |
| 2014/0126170 | A1 | 5/2014 | Bai et al. | |
| 2014/0170865 | A1 | 6/2014 | Peterson et al. | |

* cited by examiner

INDICATOR MODULE FOR MODULAR COMPUTING UNITS

BACKGROUND

The present disclosure relates to sub-rack modular computing units, and more specifically, to displaying information for sub-rack modular computing units.

Modern server platforms and various other processing platforms (such as professional audio and/or video processing systems, telecommunications systems, control systems, etc.) are designed to support a plurality of modular nodes having standardized form factors. Each modular node provides particular function(s) to the larger system, and may be arranged within a common chassis.

Conventionally, modular nodes each include multiple display indicators (such as light emitting diodes, or LEDs) on a front panel that are used for communicating operational status and other information to a user of the modular node. Certain types of modular nodes, such as network switches, may also include a number of physical ports on the front panel. The wiring connected to these ports often obscures the display indicators for the user. Additionally, because the area of a front panel is typically limited by the modular node's form factor, elements such as display indicators and physical ports all compete for available space with structural and cooling elements. Suitably dimensioned cooling elements, such as vent portions permitting air flow through the modular computing unit, are also important as the power density of components within the modular nodes continues to increase.

SUMMARY

Embodiments disclosed herein include a chassis for mounting sub-rack modular computing units, the chassis comprising a frame defining support surfaces to support a plurality of modular computing units and further defining an opening, and an indicator module disposed on the frame. The indicator module comprises, on a first side wall of the indicator module, a first signal communication interface adapted to register with a corresponding signal communication interface on at least one of the plurality of modular computing units, thereby communicatively coupling the indicator module with the at least one modular computing unit in order to propagate signals from the at least one modular computing unit for display on the indicator module.

Another embodiment includes a system comprising a first modular computing unit comprising a first signal communication interface, and an indicator module coupled to the first modular computing unit. The indicator module comprises, on a first side wall of the indicator module, a second signal communication interface adapted to register with the first signal communication interface of the first modular computing unit, thereby communicatively coupling the indicator module with the first modular computing unit in order to propagate signals from the first modular computing unit for display on the indicator module.

Another embodiment includes an indicator module configured to attach to a frame, the frame defining support surfaces to support a plurality of modular computing units and further defining an opening. The indicator module comprises a first signal communication interface adapted to register with a corresponding signal communication interface on at least one of the plurality of modular computing units, thereby communicatively coupling the indicator module with the at least one modular computing unit. The indicator module further comprises one or more paths coupled to the first signal communication interface that propagate signals from the at least one modular computing unit for display on the indicator module.

BRIEF DESCRIPTION OF THE SEVERAL VIEWS OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
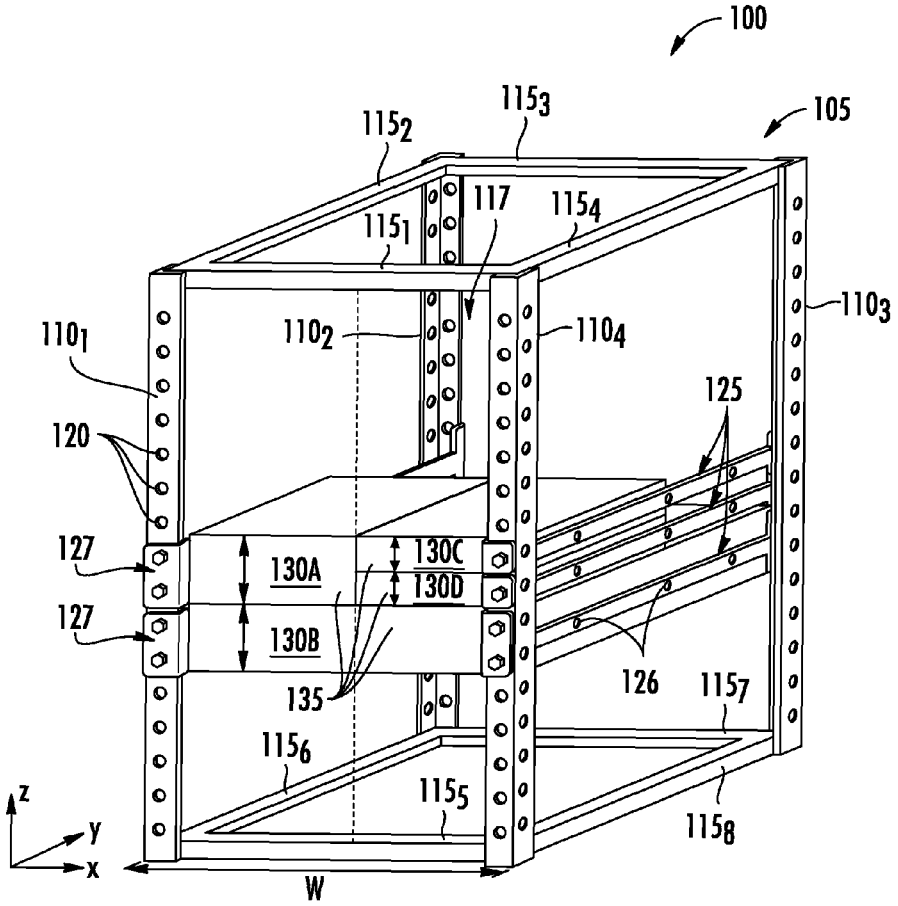
FIG. 1A illustrates a chassis for mounting sub-rack modular computing units, according to embodiments described herein.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, brief summary, or the following detailed description.

Generally, embodiments include a first modular computing unit comprising a first signal communication interface, and an indicator module coupled to the first modular computing unit. The indicator module comprises, on a first side wall of the indicator module, a second signal communication interface adapted to register with the first signal communication interface of the first modular computing unit, thereby communicatively coupling the indicator module with the first modular computing unit in order to propagate signals from the first modular computing unit for display on the indicator module.

By providing a separate indicator module for one or more modular computing units, the amount of area in the front panel of the modular computing units used for display indicators may be effectively reduced to zero. By adding a single, shared indicator module, separate indicator regions for each modular computing unit need not be included. This allows the front-panel area to be used for venting and other components, and allows greater flexibility to optimize the arrangement on the front panel. And although including a separate indicator module within a standardized chassis width may require reducing one or more dimensions of the modular computing units, the net effect across multiple modular computing units may still be an increased overall front-panel area. Indicator modules may be disposed in a standard location, which may be selected so that cabling to the front panel does not obstruct visibility of the indicator modules. The consistent placement of the indicator modules may further improve the readability of the indicator devices.

In some embodiments, the indicator modules may be disposed along a center line of the chassis, and the modular computing units may be interchangeable on the left and right sides of the chassis. In some embodiments, the modular computing units may be inserted into the chassis with different orientations. Inserting a modular computing unit with one orientation may provide a different functionality than inserting the same modular computing unit with another orientation (e.g., rotated 180°).

FIG. 1A illustrates a chassis for mounting sub-rack modular computing units, according to embodiments described herein. As shown, chassis 100 includes a frame 105 that is coupled to a plurality of modular computing units 130. The frame 105 includes a plurality of structural rails 110, 115 that are physically attached to provide support and alignment for attached modular computing units 130 and/or other components. As shown, the structural rails may be grouped into vertical rails 110 and horizontal rails 115, but alternative orientations and configurations are possible. Vertical rails $\mathbf{110}_1$, $\mathbf{110}_4$ and horizontal rails $\mathbf{115}_1$, $\mathbf{115}_5$ define a forward opening 117 of the frame 105, through which modular computing units 130 may generally be inserted to attach to the frame 105. When a particular modular computing unit 130 is attached to the frame 105, a front panel 135 of the modular computing unit 130 is generally disposed proximate to (and oriented with) the forward opening 117. In this way, the front panels 135 of multiple modular computing units 130 may be accessed on a common side of the frame 105. The dimensions of the vertical rails 110 and horizontal rails 115 may be selected to conform to standardized sizes for the modular computing units 130. For example, some common widths (w) for modular computing units and frames include 19 inches and 23 inches. Of course, modular computing units and/or frames having non-standard sizes may also be compatible with standard-sized frames and/or modular computing units by using mounting brackets or other suitable hardware.

The vertical rails 110 each include a plurality of mounting holes 120 that are used for fastening the vertical rail to the front panels of modular computing units or to any associated mounting hardware. The mounting holes 120 may be disposed along the length of the vertical rail at a regular interval or in a standardized pattern. For example, the mounting holes 120 may be disposed in a pattern to support modular computing units that are dimensioned in multiples of standardized rack units (or "U"). The standard U corresponds to a height of 44.5 millimeters (or approximately 1.752 inches). Of course, other standardized systems are possible.

The mounting holes 120 may support bolted or boltless mounting of the modular computing units 130. Edge portions 127 of the front panels 135 of modular computing units 130 may be attached to the vertical rails 110 using one or more mounting holes 120. For bolted mounting, the mounting holes 120 may be tapped to receive a threaded bolt, or may include unthreaded holes through which a bolt is inserted and fastened using a corresponding nut. That is, a bolt may be inserted through a hole in an edge portion 127 and a corresponding hole 120, and fastened to attach the modular computing unit 130 to the vertical rail 110. For boltless mounting, the mounting holes 120 may include unthreaded holes that are shaped and dimensioned to interface with a corresponding part of a modular computing unit 130, such as by hooking or clipping the edge portions 127 into corresponding mounting holes 120.

The frame 105 may also include one or more side rails 125 that are attached to the vertical rails 110 and/or the modular computing units 130. Side rails 125 may provide additional rigidity to the frame 105, and may specifically provide structural support for the modular computing units 130 along the depth of the frame 105 (corresponding to the y-axis as shown). The side rails 125 may include one or more mounting holes 126, through which a bolt may be inserted to fasten to a corresponding (tapped) hole in the side of a modular computing unit 130.

The rail structure of the frame 105 may accommodate modular computing units 130 of various depths, and may accommodate other components that are provided to support the operation of modular computing units 130. For example, the frame 105 may accommodate power supplies providing electrical power to the modular computing units, and cooling systems for removing heat from the modular computing units 130. The frame 105 may also accommodate structures that provide interconnectivity between the various modular computing units 130, such as one or more backplanes that physically attach to connectors included in the modular computing units 130.

While shown for clarity as a skeletal frame having a substantially orthogonal rail structure, chassis 100 may include alternate configurations of frame 105. For example, the rail structure may include one or more substantially non-orthogonal portions, and/or the modular computing units 130 may be partially or entirely enclosed by one or more walls or other components. In some cases, an enclosed configuration may be desirable to isolate sensitive components from the conditions of an external environment (e.g., heat, humidity, dust, EMI, etc.), as well as to provide better-controlled cooling for the modular computing units 130. Additionally, the chassis 100 may be a standalone unit or may be mounted in a larger rack.

The modular computing units 130 are generally included to provide functionality to a system, and may include fully enclosed units and/or units having exposed components. For example, modular computing units 130 may include blade servers having an exposed main board and/or attached components. In some embodiments, the modular computing units 130 may provide a modular, scalable computing platform, in which the modular computing units each provide distinct services for the computing platform (such as distinct computing modules, storage modules, acceleration modules, and so forth). In one embodiment, the computing platform may be used as a server or other networking platform. In other embodiments, the modular system may be used in alternative applications, such as professional audio and/or video processing systems, telecommunications systems, entertainment control systems, industrial control systems, military systems, and so forth.

The front panels 135 generally provide an interface to each modular computing unit 130 for a user and/or other modular computing units or devices. Front panels 135 may include interconnectivity (such as one or more ports for networking or input/output devices), a display including one or more indicators of operational status of the modular computing unit 130, input devices for receiving user inputs (such as buttons or a directional pad), as well as venting areas to permit airflow through the modular computing unit 130 for cooling components.

The modular computing units 130 may have varying dimensions. For example, the modular computing units may be full-width (such as modular computing unit 130B) or a fraction of the full width of the frame 105, such as half-width (130A, 130C, 130D) modules. The front panels 135 may have different standard or non-standard heights, e.g., 1 U, 2 U, 3 U, 4 U, and so forth. For example, modular computing unit 130A may correspond to a 2 U height, while modular computing units 130C, 130D may correspond to a 1 U height.

Figure 1B:
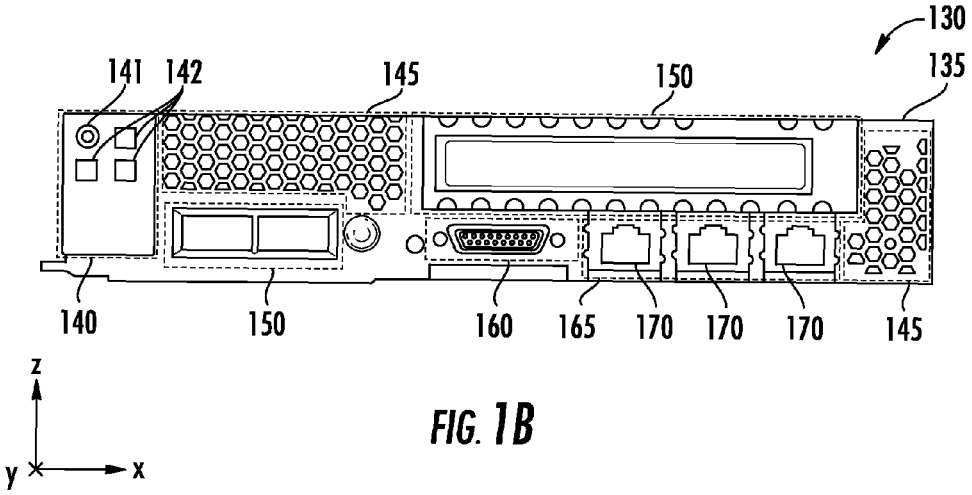
FIG. 1B illustrates an example sub-rack modular computing unit, according to embodiments described herein.

FIG. 1B illustrates an example sub-rack modular computing unit, according to embodiments described herein. Specifically, FIG. 1B shows a view of the front panel 135 of a modular computing unit 130, which may generally correspond to one of the half-width modular computing units 130A, 130C, 130D shown in FIG. 1A. Of course, the person of ordinarily skill will understand that similar characteristics may also apply to modular computing units of different size, such as full-width modular computing unit 130B.

The front panel 135 includes an indicator region 140 that has one or more display indicators for communicating operational status or other information to a user of the modular computing unit 130. The display indicators may include discrete light sources (such as LEDs). The light from the light sources may be unmodified (e.g., allowing an LED to blink or illuminate) or may be projected through a pattern (such as a distinct shape) to indicate to a user what the particular display indicator represents. For example, light for one particular indicator may be projected through an exclamation mark shape to indicate a condition requiring the user's attention. The indicator region 140 may also include one or more user input devices, such as buttons. The input devices may be distinct from the display indicators, or may be integrated. As shown, the indicator region 140 includes an illuminating power button 141 (one example of an integrated input device-display indicator) and display indicators 142. Of course, the person of ordinary skill will understand that other known methods of input and output may be used consistent with these characteristics. For example, the indicator region 140 may include an integrated touchscreen or other types of input devices.

The front panel 135 may include one or more venting regions 145. The venting regions 145 may be of suitable size and suitably located on the front panel 135 to allow adequate air flow through the modular computing unit 130 for cooling components. The venting regions 145 may include a number of relatively larger openings having no (or relatively little) structural material disposed therein, or may include a grid of structural material defining a number of smaller openings.

The front panel 135 may also include one or more expansion bays for supporting add-on cards or modules for the modular computing unit 130. For example, the modular computing unit 130 may support a standardized card (e.g., PCIe) or a proprietary card that includes additional physical ports. The expansion bays may correspond to interface regions 150 providing an external interface for the cards or modules. The interface regions 150 may include removable faceplates. The front panel 135 may also include a number of input/output (I/O) ports for communicatively coupling with the modular computing unit 130. For example, the front panel 135 may include ports providing individual functions, or may include integrated ports such as a keyboard, video, monitor (KVM) port 160 for coupling different I/O devices. The front panel 135 may also include one or more network ports 170 for network connections.

Figure 2:
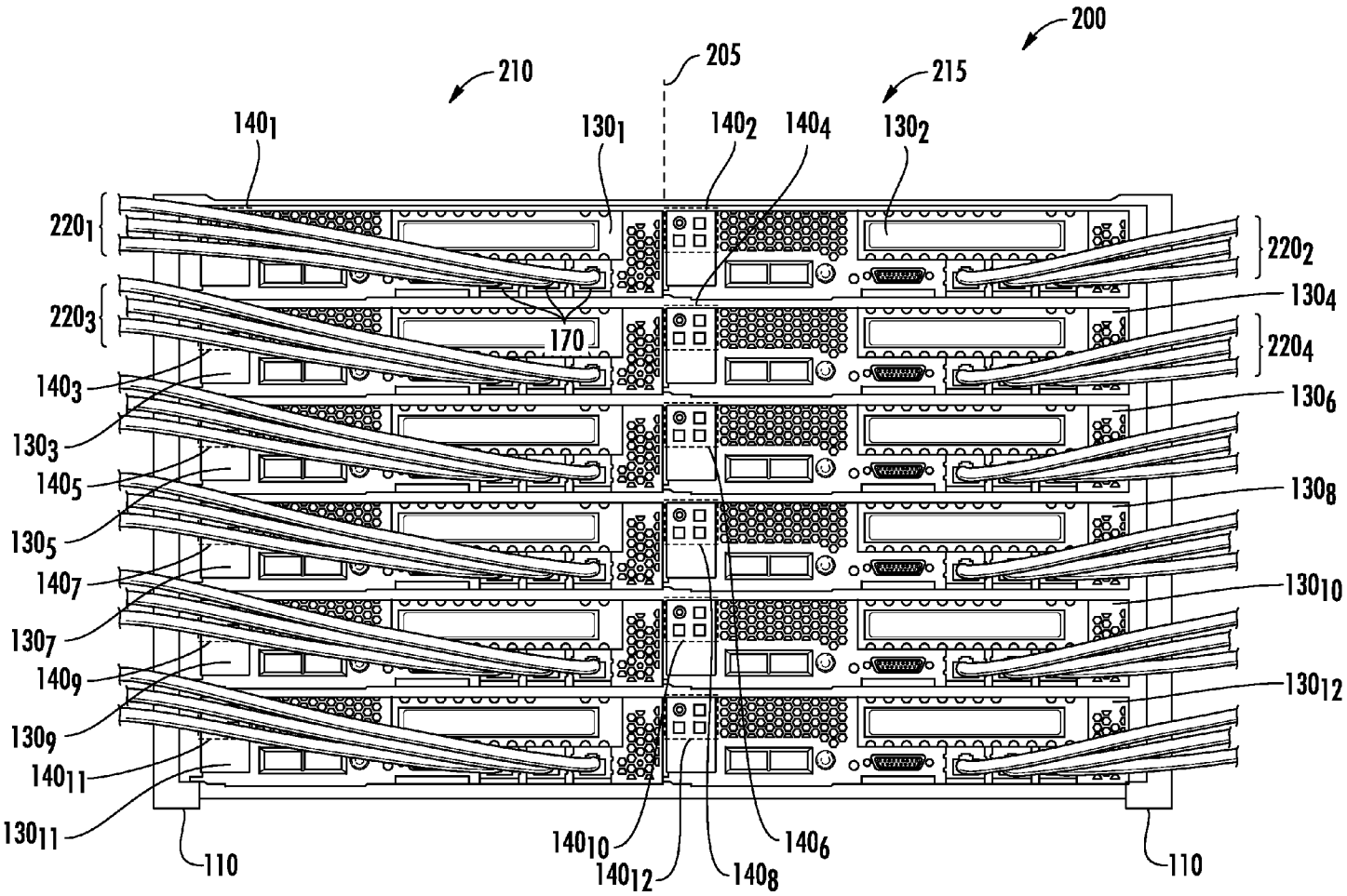
FIG. 2 illustrates a plurality of mounted and networked modular computing units, according to embodiments described herein.

FIG. 2 illustrates a plurality of mounted and networked modular computing units, according to embodiments described herein. As shown, chassis configuration 200 includes twelve half-width modular computing units $\mathbf{130}_{1\text{-}12}$. A center line 205 divides the configuration 200 into left-side 210 and right-side 215 modular computing units. Of course, the left-side and right-side descriptors used here may not apply where chassis configuration 200 has an alternative orientation. For example, if the entire chassis were rotated 90 degrees around the y-axis, the center line 205 may divide the configuration into top and bottom groups of modular computing units, and so forth. Generally, each side may be similarly configured to receive modular computing units, so that any particular modular computing unit 130 may perform substantially identically on either the left side 210 or on the right side 215. As shown, the indicator regions 140 are disposed in substantially the same relative location (e.g., to the far left) on the front panel of the corresponding modular computing unit 130.

Cabling 220 is provided to each of the modular computing units to provide desired connectivity during operation. As shown, cabling 220 includes three cables connected to network ports 170 of each modular computing unit 130. Of course, different numbers of cables may be present depending on the configuration of the modular computing unit 130 as well as its current usage. For example, the KVM ports 160 may include additional cables, and the expansion bays may house expansion cards with additional physical ports that have corresponding cables attached. As is apparent in FIG. 2, the cabling 220 attached to the various modular computing units 130 can obscure a user's view of the indicator regions 140. Although cabling may be arranged in a particular manner to keep the indicator regions 140 unobscured for a user in one relative position, any change to the user's relative position may cause the view to be obscured, due to the effects of parallax. Additionally, a user's ability to monitor multiple modular computing units 130 may be more difficult due to the fact that the indicator regions $\mathbf{140}_{1,3,5,\ldots}$ on the left side 210 are spatially separated from the indicator regions $\mathbf{140}_{2,4,6,\ldots}$ on the right side 215.

Figure 3A:
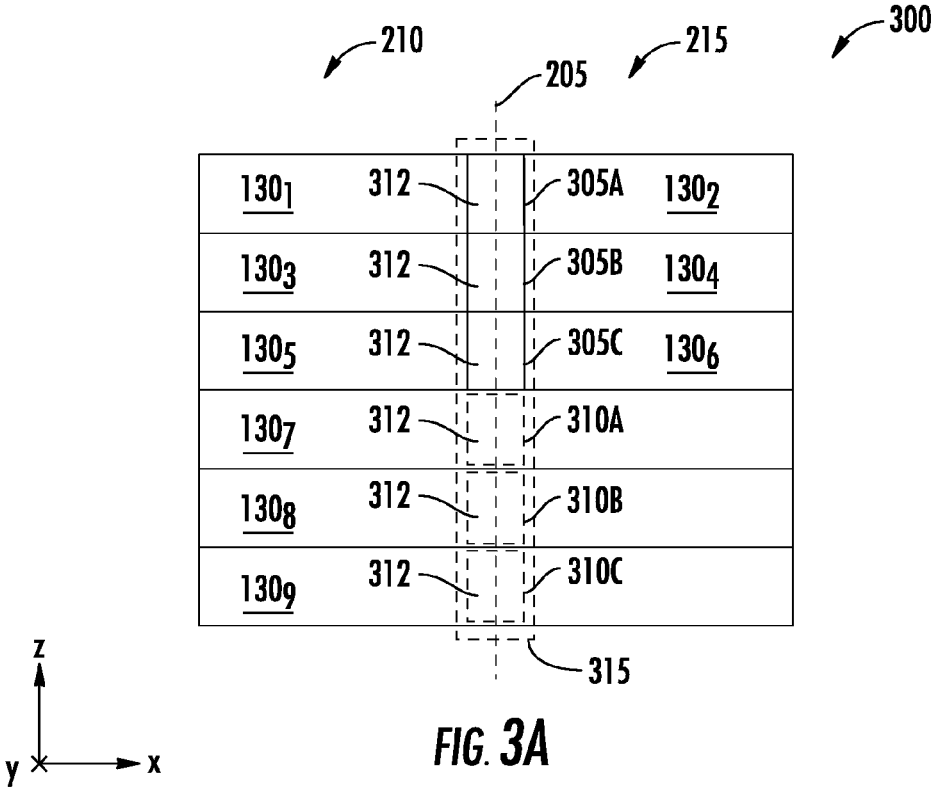
FIGS. 3A-3D illustrate a plurality of mounted modular computing units including indicator modules, according to embodiments described herein.

FIGS. 3A-3D illustrate a plurality of mounted modular computing units including indicator modules, according to embodiments described herein. Specifically, FIG. 3A illustrates an arrangement having a plurality of half-width modular computing units $\mathbf{130}_{1\text{-}6}$ and a plurality of full-width modular computing units $\mathbf{130}_{7\text{-}9}$. The chassis arrangement 300 may generally be similar to the chassis arrangement 200 depicted in FIG. 2. In one embodiment, however, chassis arrangement 300 includes indicator modules 305A-C that are disposed between half-width modular computing units 130 of the left side 210 and of the right side 210. The indicator modules 305A-C attach to the frame and are disposed adjacent to half-width modular computing units that are inserted into the chassis. In some embodiments, the indicator modules may also provide structural support for inserted modular computing units, including a rail or other surface to which the modular computing units may removably attach.

When the half-width modular computing units 130 are fully inserted into the chassis (or "seated"), signal communication interfaces of the half-width modular computing units 130 align with one or more corresponding signal communication interfaces of the indicator modules 305. Aligning these regions allows each indicator module 305 to communicatively couple to one or more modular computing units 130; for example, indicator module 305A may communicate with adjacent modular computing units $\mathbf{130}_{1,2}$. In one embodiment, optical components of a modular computing unit 130 are optically coupled to the indicator module 305. In another embodiment, circuitry of the modular computing unit 130 is electrically coupled (e.g., conductive, capacitive, inductive, etc.) to the indicator module 305. In another embodiment, the indicator modules 305 may be configured to support both optical and electrical connections. For example, the indicator module 305 may be compatible with separate types of modular computing units, or a particular modular computing unit having both optical and electrical connections.

As shown, the full-width modular computing units $\mathbf{130}_{7\text{-}9}$ are disposed beneath the half-width modular computing units $\mathbf{130}_{1\text{-}6}$. While full-width modular computing units $\mathbf{130}_{7\text{-}9}$ in many cases are dimensioned such that spacing for a discrete indicator module 305 is not included in the chassis, the full-width modular computing units $\mathbf{130}_{7\text{-}9}$ may include indicator portions 310A-C that correspond in size and/or position with the indicator modules 305A-C. The indicator portions 310A-C may generally operate similarly to display information to a user of the modular computing units, and the similarity to indicator modules 305A-C may further enhance the readability of all the indicators within the chassis. More specifically, the front panels 312 of the indicator portions 310A-C and of the indicator modules 305A-C may all be in a predetermined arrangement to enhance viewability. As shown, all of the front panels are included in a contiguous region 315. In one example, the front panels 312 are centered on a center line 205 separating modular computing units of the left side 210 from those of the right side 215. In other embodiments, such as the arrangement 320 depicted in FIG. 3B, the front panels 312 may be arranged at alternate positions, such that the region 315 is entirely disposed to one side of the full-width and half-width modular computing units. For example, the full-width modular computing units $\mathbf{130}_{7\text{-}9}$ may have indicator regions 310A-C at a fixed pre-determined location. A user could select the placement of the indicator modules 305A-C to match the indicator regions 310A-C and form the single contiguous region 315. In some embodiments, the various front panels 312 may have different dispositions (which may be based on user preference), and may form one or more groupings of contiguous front panels to provide improved readability. For example, front panels 312 for the indicator modules 305A-C may be disposed at a center position while the front panels of indicator portions 310A-C are disposed to the left or right sides. Of course, other arrangements are possible. In some embodiments, the region 315 may be disposed away from the front panels of the modular computing units 315 entirely, and may be disposed to a side of the chassis, behind the modular computing units, and so forth.

Figure 3B:
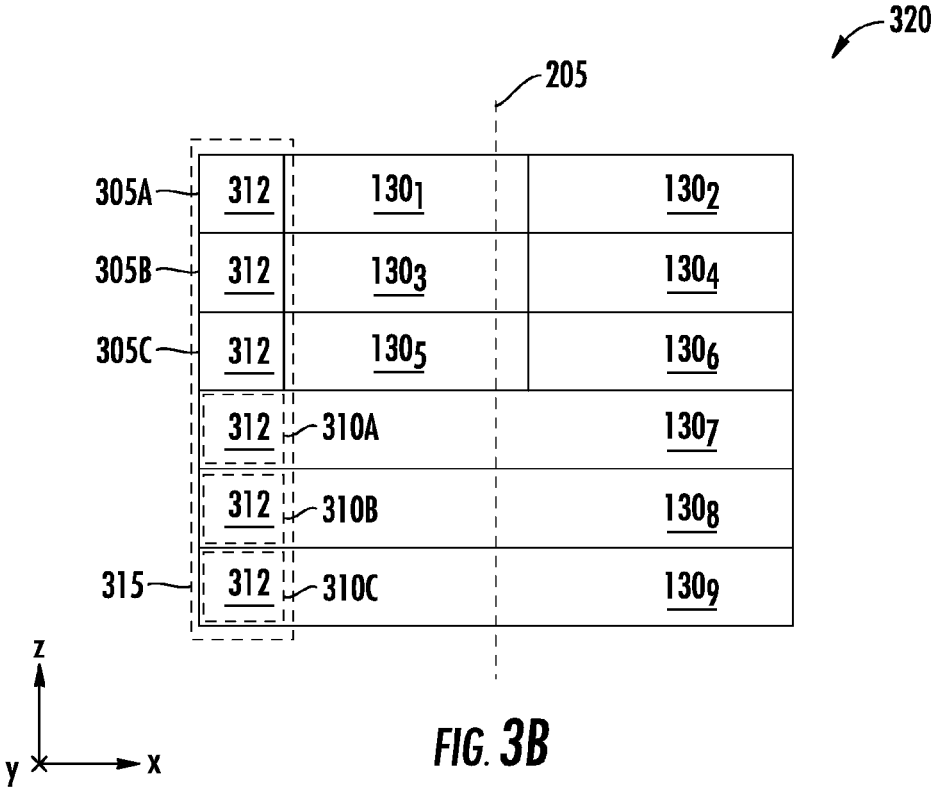
Figure 3C:
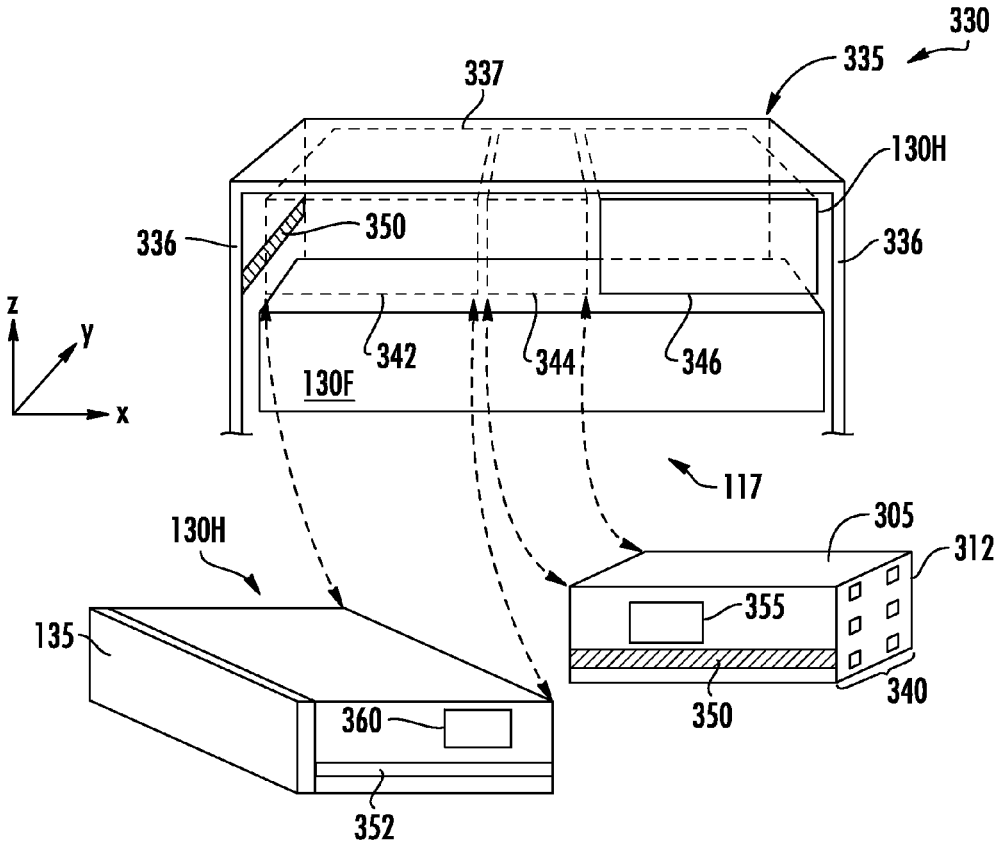

FIG. 3C illustrates a plurality of half-width modular computing units 130H and a full-width modular computing unit 130F. Specifically, chassis arrangement 330 depicts a portion of a chassis 335 that includes a plurality of sidewalls 336 and a top wall 337 that at least partially enclose attached modular computing units. As shown, the chassis 335 has a full-width modular computing unit 130F and a half-width modular computing unit 130H installed. A half-width modular computing unit 130H and an indicator module 305 are depicted separately to illustrate attachment and removal from the chassis 335 as well as reconfiguration of the chassis 335.

Although not all variants are depicted here, the indicator module 305 may include various structural elements used to connect to framing elements and to modular computing units. For example, the indicator module 305 may include rails, slides, notches, grooves, etc. that correspond to structural elements on the modular computing unit 130H. When modular computing unit 130H is inserted into chassis 335, the structural elements of the modular computing unit may couple to the corresponding structural elements on the chassis 335 and/or the indicator module 305. As shown, the modular computing unit 130H includes a protruding portion 352 on each side that engages rails 350 disposed on the sidewall 336 and the indicator module 305. Of course, other configurations of complementary structural elements are possible. The indicator module 305 and/or the modular computing unit 130H may further include mechanical stops or catches that limit the relative motion of the modular computing unit 130H and indicator module 305, ensuring that their corresponding serial communication interfaces 355, 360 register to allow communication between the modular computing unit 130H and indicator module 305.

Figure 3D:
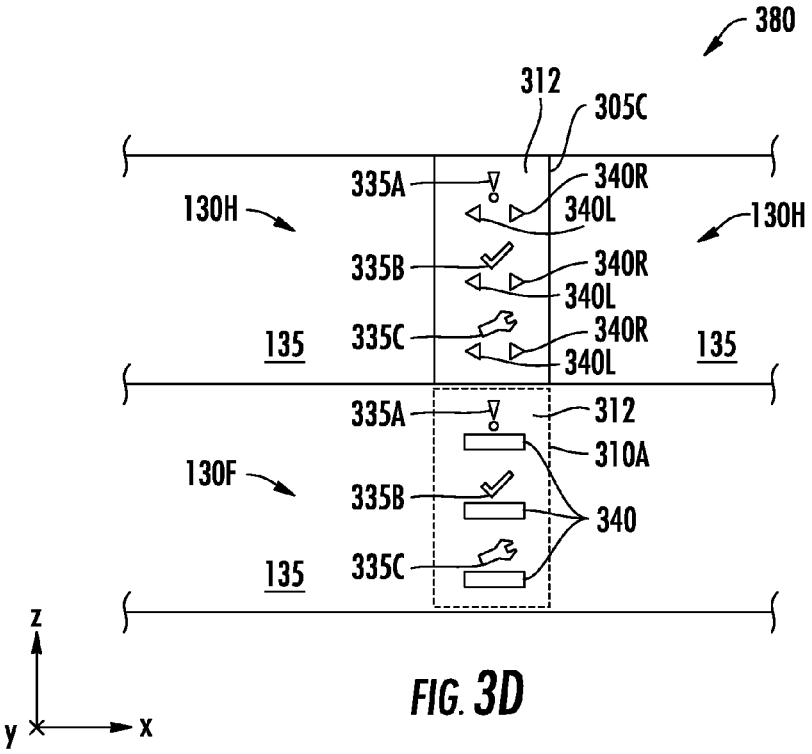

FIG. 3D illustrates a plurality of half-width modular computing units 130H and a full-width modular computing unit 130F. An indicator module 305C is disposed between the half-width modular computing units 130H, and an indicator portion 310A is included in the full-width modular computing unit 130F. The respective front panels 312 of indicator module 305C and indicator portion 310A are aligned with each other. Indicator module 305C and indicator portion 310A include a number of symbols 335A-C and indicators 340 corresponding to each symbol. The symbols 335 may generally be selected to inform a user as to the meaning of the corresponding indicator 340. As shown, symbols 335 include an exclamation mark 335A (e.g., indicating that a condition requires user attention), a check mark 335B (e.g., indicating normal operation), and a wrench 335C (e.g., indicating repair is needed). The symbols may be formed in the front panels 312, applied to the front panels 312 as decals or paint, and so forth. In some embodiments, the symbols may be patterns defining openings in the front panels 312, and the pattern may be illuminated. Of course, other symbols may be preferentially selected. In other embodiments, no symbols are included on the front panels 312, which may allow for a greater number of indicators 340 to be included within a limited area, or alternatively to minimize the front panel area for the particular number of indicators 340. To identify a particular pattern of illuminated indicators, a user may manually refer to a reference card, manual, or other diagnostic document, or may use an application on a smartphone or other mobile computing device to photograph the pattern, and to retrieve and present the corresponding information to the user.

In one embodiment, the indicator module 305C may include two indicators for each symbol 335, each indicator generally corresponding to one of the two half-width modular computing units 130H. The indicators may be shaped and/or positioned to more clearly identify the corresponding half-width modular computing unit 130H. As shown, each symbol 335 corresponds to a left-side indicator 340L and a right-side indicator 340R, which are relatively disposed to the left and right on the front panel 312. The left-side indicator 340L and right-side indicator 340R are also triangular, with one angle of each indicator "pointing" to the respective sides. Of course, other shapes and dispositions of the indicators may be selected consistent with the principles described herein. The person of ordinary skill will also understand that different properties of the indicators (such as light colors, intensities, frequencies, and so forth) may be selected and/or altered to convey additional information to a user. In one embodiment, the indicator portion 310A of full-width modular computing unit 130F includes one indicator for each symbol 335. The indicators 340 of the indicator portion 310A may be of any preferred size, shape, and disposition. Generally, the indicator portion 310A does not need to include information for distinguishing between left and right sides (as in the indicator module 305C).

By providing the separate indicator module 305C for the two half-width modular computing units, the amount of front-panel area required by the modules for display indicators may be effectively reduced to zero, which allows for more (or for optimized) front-panel area for venting and other components. Further, even though including an separate indicator module within a standardized chassis width may require reducing one or more dimensions of the half-width modular computing units, the net effect across two half-width modular computing units may still be an increased overall front-panel area, as two separate indicator regions have been consolidated into a single indicator module 305. Furthermore, the consistent placement of the indicator modules 305C (as well as indicator portion 310A of full-width modular computing units) may improve the readability of the indicator devices.

Figure 4A:
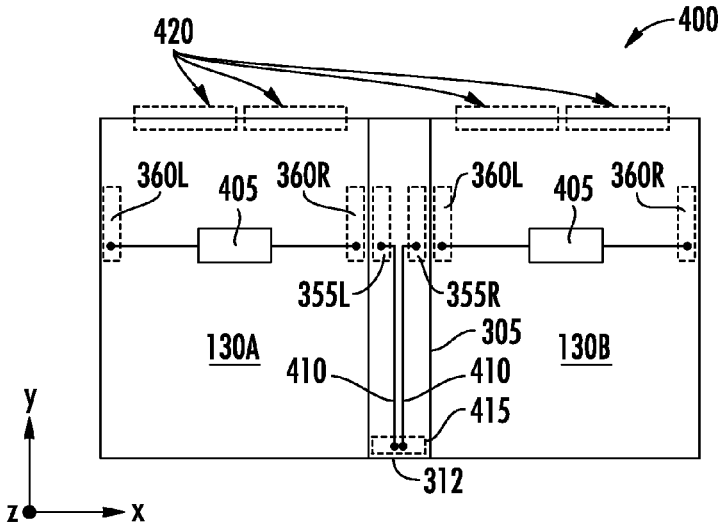
FIGS. 4A-4C illustrate a plurality of mounted modular computing units including indicator modules, according to embodiments described herein.

FIG. 4A illustrates a plurality of half-width modular computing units 130A, 130B coupled to an indicator module 305. Specifically, configuration 400 illustrates connectivity of the half-width modular computing units 130A, 130B with an indicator module 305 and to one or more backplanes (not shown) through connectors 420. Each modular computing unit may include one or more signal communication interfaces 360 that register with a corresponding signal communication interface 355 disposed on a sidewall of the indicator module. The signal communication interfaces 355, 360 may be registered when the corresponding modular computing unit is fully inserted through the forward opening into the chassis. When registered, the signal communication interfaces 355, 360 are communicatively coupled, and a processing device 405 of the modular computing unit may transmit signals to the indicator module 305 for display at a display portion 415 disposed near the front panel 312. The processing device 405 may include a separately-purposed processor or controller, or may include another processing device that performs various other functions of the modular computing unit 130. In some cases, the display portion 415 may house the individual indicator devices (e.g., LEDs) that are observed at front panel 312, and may include additional circuitry for driving the indicator devices and/or processing the signals transmitted by the processing device 405 and propagated over paths 410. As will be discussed below, paths 410 may include electrical and/or optical elements for coupling the signal communications interfaces 355L, 355R to the display portion 415. For example, additional circuitry at the display portion 415 may encode signals provided by the processing device 405 into a user-readable display format (e.g., display using a seven-segment indicator). Additionally, the indicator module 305 may include one or more input devices, and input information may be received by the processing device 405 and used for operating the modular computing unit 130.

As shown, the modular computing units 130A, 130B each include two signal communication interfaces 360L, 360R that correspond to left and right sides of the modular computing unit. Having signal communication interfaces 360L, 360R allows a particular modular computing unit to operate substantially similarly, whether inserted on left or right sides of a chassis. Additionally, the chassis may include one or more backplanes that provide various functionality (e.g., communications, processing) to connected modular computing units 130A, 130B. The modular computing units may include a number of different connectors 420 for coupling to select ones or all of the backplanes in the chassis.

In some embodiments, the modular computing units 130 may have different connectivity with the indicator module 305 based on the location and/or orientation of the modular computing unit within the chassis. In one example, a modular computing unit 130 may include one signal communication interface 360 and require the modular computing unit to be inserted in a particular manner to couple to the indicator module 305. For example, a modular computing unit could be designated as a "left-side" module, including only a right-side signal communication interface 360R that registers with a left-side signal communication interface 355L of the indicator module 305. When inserted in the right side of the chassis, the right-side signal communication interface 360R would not register with a corresponding signal communication interface 355 of the indicator module 305. In another example, the modular computing unit may include signal communication interfaces 360 that register and/or couple differently with corresponding signal communication interfaces 355 based on the orientation of the modular computing unit. For example, the modular computing unit 130A as shown has a right-side signal communication interface 360R that registers with signal communication interface 355L. If the modular computing unit 130A were rotated 180° about the y-axis (i.e., "upside-down") and inserted into the chassis, the signal communication interface 360L would instead register with signal communication interface 355L. In some cases, the signal communication interface 360L may include one or more portions that are physically distinct from signal communication interface 360R, and the corresponding signal communication interface 355L may couple to the modular computing unit 130A differently with these distinct portions than when the portions are not included. In other cases, the physical layout of signal communication interfaces 360L, 360R may be the same, but different functionality is provided by the modular computing unit 130A depending on which of the signal communication interfaces is registered to the signal communication interface 355 of the indicator unit 305.

Figure 4B:
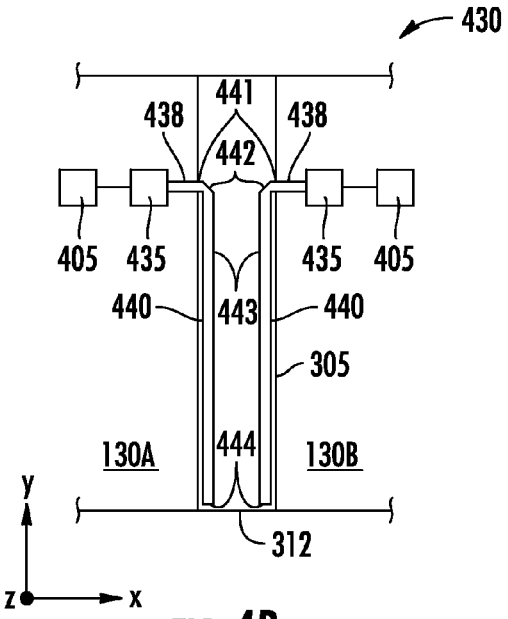

FIG. 4B illustrates a plurality of half-width modular computing units 130A, 130B coupled to an indicator module 305. FIG. 4B depicts one possible implementation of the configuration 400 described above. Specifically, configuration 430 illustrates the connectivity of the half-width modular computing units 130A, 130B with an indicator module 305 using optical connections. Modular computing units 130A, 130B each include a processing device 405 coupled to optical components 435. The processing device 405 generally drives the optical components 435 to produce a desired optical output. The optical components 435 may include the indicator devices (such as one or more LEDs) and may have its optical output(s) directed into optical path(s) 438.

When the modular computing unit is fully inserted into the chassis, the optical path 438 of the particular modular computing unit aligns with a corresponding optical path 440 of the indicator module 305 at optical interface 441. The optical paths 438, 440 may generally include any feasible materials and geometries for propagating optical signals. For example, optical paths 438, 440 may include any of optical waveguides, optical fibers, and so forth. In one embodiment, optical paths 438, 440 include light pipes or light tubes that propagate optical signals using a transparent plastic resin. The optical path 440 may include one or more legs 443 and one or more bends 442 to propagate the optical signal received at optical interface 441 to the display end 444 at front panel 312. The display ends 444 may correspond to a pair of indicators 440 (i.e., left-side indicator 340L, right-side indicator 340R), described above with respect to FIG. 3D. At bends 442, the optical path 440 may include one or more mirroring or collimating geometries for redirecting and/or focusing the optical signal. As shown, optical path 438 is oriented with an approximately 90° difference from the leg 440. Bend 442 includes a mirroring geometry at approximately 45° from the optical path 438 to reorient the light received at optical interface 441 to more efficiently propagate along leg 443. Light pipes may therefore be used to provide an inexpensive, entirely passive implementation of the indicator module 305.

Figure 4C:
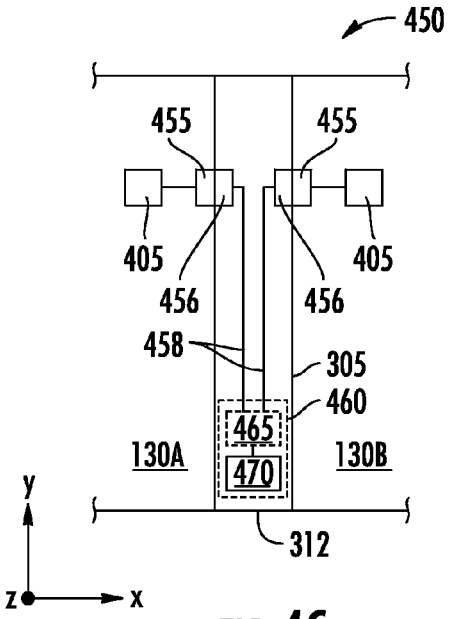

FIG. 4C illustrates a plurality of half-width modular computing units 130A, 130B coupled to an indicator module 305. FIG. 4C depicts one possible implementation of the configuration 400 described above. Specifically, configuration 450 illustrates the connectivity of the half-width modular computing units 130A, 130B with an indicator module 305 using electrical coupling. Modular computing units 130A, 130B each include a processing device 405 that delivers a desired output signal to an electrical connector 455. In turn, the indicator module 305 may include corresponding electrical connectors 456 that couple to the electrical connectors 455 when the modular computing units are fully inserted into the chassis. The electrical connectors 456 are also connected via connections 458 (e.g., wires or conductive traces) to a display module 460 for receiving the output signal, optionally processing the output signal, and driving the display indicators at the front panel 312. In one embodiment, the electrical connectors 455, 456 may physically connect, providing a conductive path for the output signals. In other embodiments, the electrical connectors 455, 456 may not conductively connect, but couple through capacitive or inductive coupling.

The display module 460 generally corresponds to the display portion 415 described above with respect to FIG. 4A. Specifically, display module 460 includes the indicator device(s) 470 (e.g., LEDs, a touchscreen, etc.) that are observed at front panel 312, and may include additional circuitry 465 used for driving the indicator device(s) 470 and/or processing the output signal transmitted by the processing device 405. The circuitry 465 may generally include a discrete processor or controller. Additionally, the display module 460 may include one or more input devices (e.g., buttons, the touchscreen, etc.), and may process input using circuitry 465 and/or transmit the input to processing devices 405 in order to control operation of the modular computing units 130A, 130B.

Figure 5A:
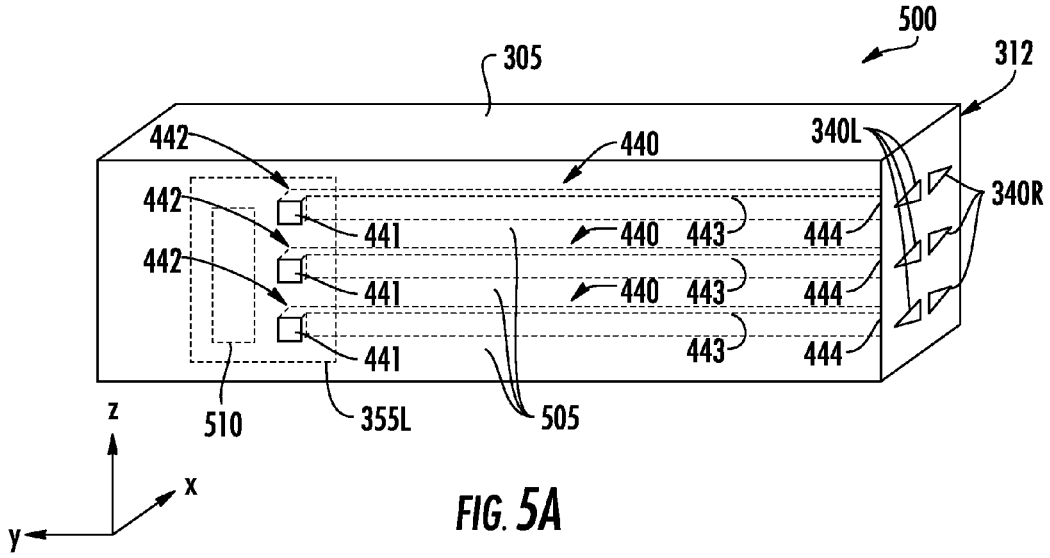
FIG. 5A illustrates an indicator module for communicatively coupling to a plurality of modular computing units, according to embodiments described herein.

FIG. 5A illustrates an indicator module for communicatively coupling to a plurality of modular computing units, according to embodiments described herein. Specifically, FIG. 5A includes a side view 500 of indicator module 305. Within signal communication interface 355L are a plurality of optical interfaces 441 for optical coupling with a modular computing unit. Indicator module 305 also includes a plurality of optical paths 440 with bend 442, leg 443, and a display end 444 disposed at front panel 312. Each of the display ends 444 is arranged to output an optical signal received at the optical interface 441 through a respective indicator 340L. The indicator module 305 may include regions 505 separating the optical paths 440. The regions 505 may include any material(s) having suitable structural, electrical, and optical properties. For example, regions 505 may be electrically and optically insulative, and may include an opaque plastic.

Signal communication interface 355L may also include one or more electrically conductive portions 510 providing another path for communicatively coupling with a modular computing unit 130. The electrically conductive portions 520 may be connected to other circuitry (not shown). In one example, the electrically conductive portions 510 may be exposed at an edge of the modular computing unit 130, and may physically couple with a corresponding portion of modular computing unit 130. In another example, the electrically conductive portions 510 may be embedded within the indicator module 305 and arranged to capacitively and/or inductively couple to the corresponding portions of the modular computing unit. For example, the embedded portions may include a capacitive planar electrode or an inductive coil. The indicator module 305 may therefore be configured to communicate with modular computing units supporting only optical connections, modular computing units supporting only electrical connections, and modular computing units that support both types of connections.

Figure 5B:
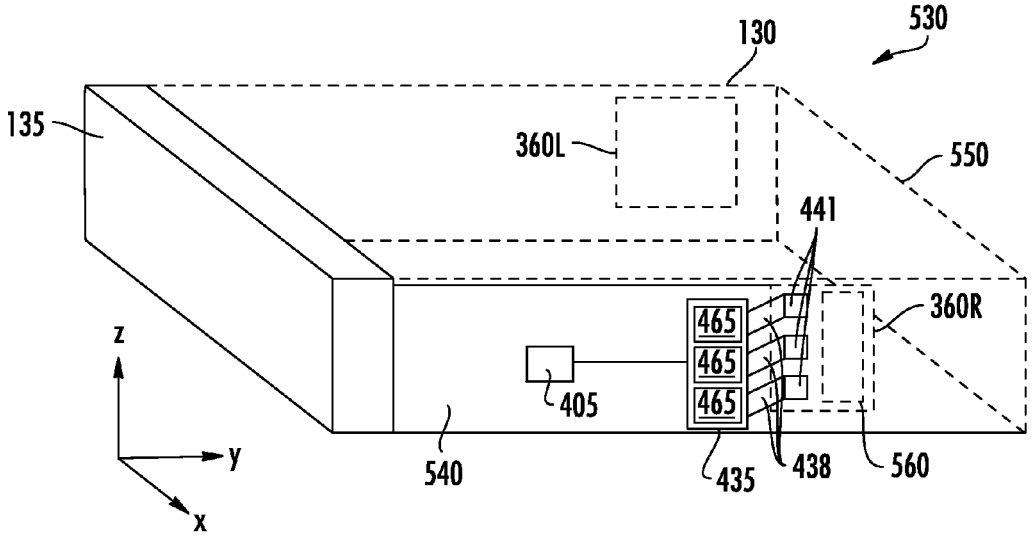
FIG. 5B illustrates a modular computing unit for communicatively coupling to an indicator module, according to embodiments described herein.

FIG. 5B illustrates a modular computing unit for communicatively coupling to an indicator module, according to embodiments described herein. Specifically, FIG. 5B shows a side view 530 of a modular computing unit 130 that is configured to couple with the indicator module 305 shown in FIG. 4A. The modular computing unit 130 includes a front panel 135 physically and communicatively coupled to a circuit board 540. A housing 550 may be provided to enclose the circuit board 540 and other components. The circuit board 540 may include the processing device 405 and optical components 435, which as shown includes a plurality of optical sources 465 (such as LEDs). The processing device 405 transmits signals that drive the optical sources 465 to output optical signals on optical paths 438 to optical interface 441. The signal communication interface 360R may further include electrically conductive portions 560 for communicatively coupling with the indicator module 305, such as through corresponding electrically conductive portions 510. The electrically conductive portions 560 generally may include conductive contacts, capacitive components, and/or inductive components.

Though not depicted in detail, the modular computing unit 130 may also include a signal communication interface 360L that has a similar configuration of optical interfaces and/or conductive portions for coupling to an indicator module 305. Depending on the configuration, the signal communication interfaces 360L, 360R may register with a corresponding signal communication interface on the indicator module 305 (e.g., signal communication interface 355L or 355R) and/or a corresponding signal communication interface included in an adjacent modular computing unit 130. For example, the chassis arrangement 320 of FIG. 3B shows half-width modular computing units $\mathbf{130}_1$, $\mathbf{130}_2$ disposed adjacent to each other. The signal communication interfaces of these modular computing units may register to allow communication between the modular computing units.

Communication may also occur, e.g., between the indicator module 305A and a non-adjacent modular computing unit (e.g., $\mathbf{130}_2$). Output signals from the non-adjacent modular computing unit may be passively or actively (e.g., processed) propagated through the signal communication interfaces of the adjacent modular computing unit (e.g., $\mathbf{130}_1$) before being received at the indicator module 305A.

Returning to FIG. 5B, In one embodiment, the modular computing unit 130 may connect at signal communication interface 360R to signal communication interface 355L of modular computing unit 130, and may be rotated 180° around the y-axis to connect at signal communication interface 360L to signal communication interface 355L. As discussed above, the signal communication interface 360L may include one or more portions that are physically distinct from signal communication interface 360R, and the corresponding signal communication interface 355L may couple to the modular computing unit 130 differently with these distinct portions than when the portions are not included. In other cases, the physical layout of the signal communication interfaces 360L, 360R may be the same, but different functionality is provided by the modular computing unit 130 depending on which signal communication interface is coupled to the indicator unit 305.

CONCLUSION

Various embodiments disclosed herein provide an architecture for modular sub-rack units. Embodiments may include an indicator module attached to a chassis frame and disposed adjacent to at least one modular computing unit. By providing a separate indicator module for one or more modular computing units, the amount of area in the front panel of the modular computing units used for display indicators may be effectively reduced to zero. Accordingly, the front panels of the modular computing units may be used for venting and other components with greater flexibility to optimize their arrangement. Indicator modules may be disposed in a standard location, which may be selected so that cabling to the front panel does not obstruct visibility of the indicator modules. The consistent placement of the indicator modules may further improve the readability of the indicator devices.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein. The block diagrams included in the Figures illustrate the architecture, functionality, and operation of possible implementations of systems according to various embodiments of the present disclosure.

In the preceding, reference is made to embodiments presented in this disclosure. However, the scope of the present disclosure is not limited to specific described embodiments. Instead, any combination of the preceding features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

While the foregoing is directed to embodiments of the present disclosure, other and further embodiments may be devised without departing from the basic scope thereof, and the scope thereof is determined by the claims that follow.

What is claimed is:

1. A chassis for mounting sub-rack modular computing units with corresponding first front panels, the chassis comprising:

a frame defining an interior volume in which first support surfaces of the frame at least partially support a plurality of modular computing units, the frame further defining an opening through which a portion of a first modular computing unit is received into the interior volume; and an indicator module comprising:

a housing disposed on the frame, the housing defining a second front panel disposed at the opening of the frame, and further defining a first side wall having at least a portion included within the interior volume;

a first optical indicator disposed at the second front panel;

a second support surface disposed at the first side wall; and a first signal communication interface disposed at the portion of the first side wall that is included within the interior volume, the first signal communication interface optically coupled with the first optical indicator along an optical path extending through the housing, the first signal communication interface adapted to register with a corresponding signal communication interface of the first modular computing unit when the first modular computing unit is at a first predefined position relative to the frame, whereby optical signals generated by a first light source of the first modular computing unit are propagated to the first optical indicator, wherein, at the first predefined position, a first front panel of the first modular computing unit is disposed at the opening of the frame, and the portion of the first modular computing unit that is received into the interior volume engages at least one first support surface and the second support surface.

2. The chassis of claim 1, wherein the indicator module further comprises one or more light pipes disposed within the housing and forming an optical path between the first signal communication interface and the first optical indicator, wherein terminal ends of the one or more light pipes are disposed at the second front panel.

3. The chassis of claim 1, wherein the indicator module further comprises:

a second optical indicator disposed at the second front panel; and a second signal communication interface disposed on a second side wall of the housing and adapted to register with another corresponding signal communication interface on at least one other of the plurality of modular computing units, whereby optical signals generated by a second light source of the at least one other modular computing unit are propagated to the second optical indicator.

4. The chassis of claim 3, wherein the first and second side walls are disposed on opposing sides of the housing.

5. The chassis of claim 3, wherein the second optical indicator is disposed at the second front panel.

6. The chassis of claim 1, wherein the opening corresponds to a plurality of left-side bays and right-side bays defined within the frame, each of the left-side bays and right-side bays configured to receive a half-width modular computing unit, and wherein the housing is disposed on the frame between a left-side and a right-side bay.

7. The chassis of claim 1, wherein at least a portion of the indicator module is configured to be removably inserted into the frame through the opening.

8. The chassis of claim 1, wherein the first optical indicator is formed as a predetermined symbol in the second front panel.

9. A system, comprising:

a first modular computing unit comprising a first light source optically coupled with a first signal communication interface, the first modular computing unit having a first front panel; and an indicator module coupled with the first modular computing unit and comprising:

a housing defining a second front panel and a first side wall;

a first optical indicator disposed at the second front panel of the housing;

a support surface disposed at the first side wall; and at the first side wall of the housing, a second signal communication interface adapted to register with the first signal communication interface of the first modular computing unit when the first modular computing unit is at a first predefined position relative to the indicator module, whereby optical signals generated by the first light source are propagated to the first optical indicator, wherein, at the first predefined position, the first front panel and the second front panel are aligned and a portion of the first modular computing unit engages the support surface.

10. The system of claim 9, wherein the indicator module further comprises one or more light pipes disposed within the housing and forming an optical path between the second signal communication interface and the first optical indicator, wherein terminal ends of the one or more light pipes are disposed at the second front panel.

11. The system of claim 9, wherein the indicator module further comprises:

a second optical indicator disposed at the second front panel; and a third signal communication interface disposed on a second side wall of the housing and adapted to register with a fourth signal communication interface on a second modular computing unit, whereby optical signals generated by a second light source of the second modular computing unit are propagated to the second optical indicator.

12. The system of claim 11, wherein the first and second side walls are disposed on opposing sides of the housing.

13. The system of claim 11, wherein the second optical indicator is disposed at the second front panel.

14. The system of claim 9, wherein the first modular computing unit further comprises a third signal communication interface adapted to register with the second signal communication interface of the indicator module when the first modular computing unit is at a second predefined position relative to the indicator module, and wherein the optical signals generated by the first modular computing unit differ depending on whether the first signal communication interface or the third signal communication interface is registered with the second communication interface of the indicator module.

15. The system of claim 9, wherein each of the first signal communication interface and the second signal communication interface further includes a respective electrical which, when the first signal communication interface and the second signal communication interface are registered, align to electrically couple the indicator module to the first modular computing unit.

16. An indicator module configured to attach to a frame, the frame defining an interior volume in which first support surfaces of the frame at least partially support a plurality of modular computing units having corresponding first front panels, the frame further defining an opening through which a portion of a first modular computing unit is received into the interior volume, the indicator module comprising:

a housing defining a second front panel that is disposed at the opening of the frame when the housing is at a first predefined position relative to the frame, the housing further defining a first side wall having at least a portion included within the interior volume;

a first signal communication interface disposed at the portion of the first side wall that is included within the interior volume, the first signal communication interface adapted to register with a corresponding signal communication interface of the first modular computing unit when the first modular computing unit is at a second predefined position relative to the frame, thereby optically coupling the indicator module with the first modular computing unit; and one or more optical paths coupled to the first signal communication interface that propagate optical signals from the first modular computing unit for display at the second front panel.

17. The indicator module of claim 16, further comprising a second signal communication interface adapted to register with another corresponding signal communication interface on at least one other of the plurality of modular computing units, thereby optically coupling the indicator module with the at least one other modular computing unit in order to propagate optical signals from the at least one other modular computing unit for display at the second front panel.

18. The indicator module of claim 17, wherein the first and second signal communication interfaces are disposed on opposing sides of the housing.

19. The indicator module of claim 18, further comprising one or more light pipes disposed within the housing and forming the one or more optical paths, wherein terminal ends of the one or more light pipes are disposed at the second front panel.

* * * * *